United States Patent [19]

D'Agati et al.

[11] Patent Number: 4,741,097

[45] Date of Patent: May 3, 1988

[54] LINE TIE ASSEMBLY AND METHOD

[75] Inventors: John R. D'Agati, Independence; Paul A. Daniels, Chardon, both of Ohio

[73] Assignee: Preformed Line Products, Cleveland, Ohio

[21] Appl. No.: 854,196

[22] Filed: Apr. 21, 1986

[51] Int. Cl.[4] ..... H01B 17/06

[52] U.S. Cl. ..... 29/631; 24/131 C; 57/906; 174/173; 248/63

[58] Field of Search ..... 29/631; 24/131 C; 57/906; 174/173, DIG. 12; 248/63

[56] References Cited

U.S. PATENT DOCUMENTS

| | | | |
|---|---|---|---|
| 2,202,275 | 5/1940 | Tulloch | 140/71 R |
| 2,202,538 | 5/1940 | Selquist | 174/42 |
| 2,230,611 | 2/1941 | Coffin et al. | 248/63 |
| 2,421,286 | 5/1947 | Pyle | 174/173 |
| 2,744,707 | 5/1956 | Peterson | 248/61 |
| 2,941,029 | 6/1960 | Stoeckel | 174/173 |
| 3,042,745 | 7/1962 | Williams | 174/173 |
| 3,286,023 | 11/1966 | Eucker | 174/173 |
| 3,295,311 | 1/1967 | Butz et al. | 57/212 |
| 3,501,116 | 3/1970 | Eppinger et al. | 248/63 |
| 3,555,625 | 1/1971 | Hoban | 24/131 C |
| 3,664,010 | 5/1972 | D'Agati | 29/526 R |
| 4,015,073 | 3/1977 | Dickerson | 174/148 |

FOREIGN PATENT DOCUMENTS

| | | | |
|---|---|---|---|
| 1533987 | 6/1967 | France | 174/173 |

*Primary Examiner*—Howard N. Goldberg
*Assistant Examiner*—Taylor J. Ross
*Attorney, Agent, or Firm*—Fay, Sharpe, Beall, Fagan, Minnich & McKee

[57] ABSTRACT

A line tie assembly and various methods of installing a line tie to a conductor cable are described herein. The line tie is comprised of helical end portions and a generally undeformed, non-helical central portion therebetween. The helical end portions are adapted for circumferential gripping engagement with the conductor cable. The line tie is universal such that it will accommodate various size insulators and is adaptable to both "top tie" and "side tie" arrangements in single-support and double-support constructions. According to one set of installation methods, individual components of the line tie are spread apart along the non-helical central portions and positioned over an insulator. Another set of installation methods use the insulator as a mandrel for bending the line tie into a generally U-shaped configuration.

13 Claims, 4 Drawing Sheets

A
B
C
D
10
12
14
16
18
20
22
24
34
36
38
40
42
46
48
50
52

FIG. 9
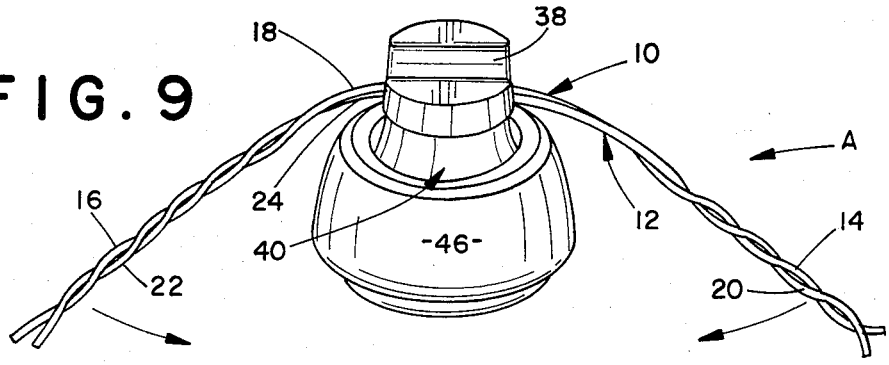
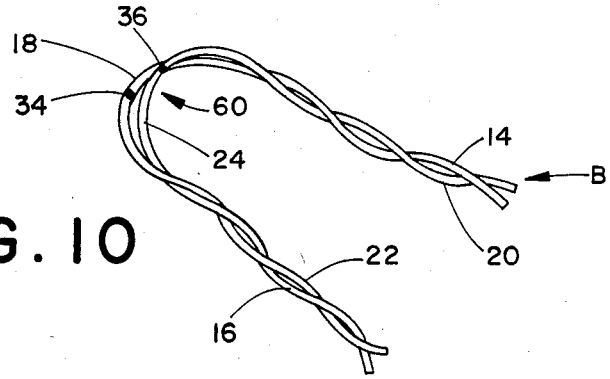
FIG. 10
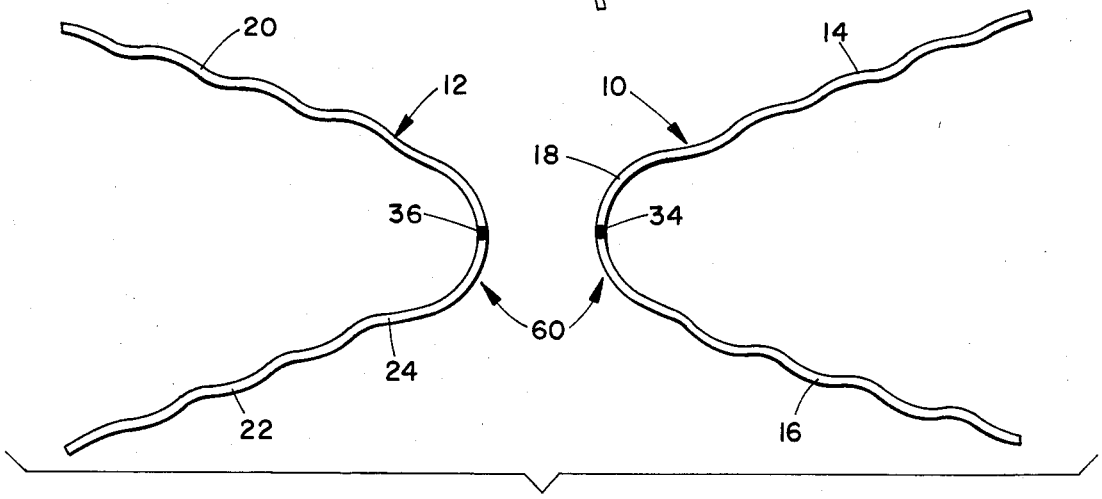
FIG. 11
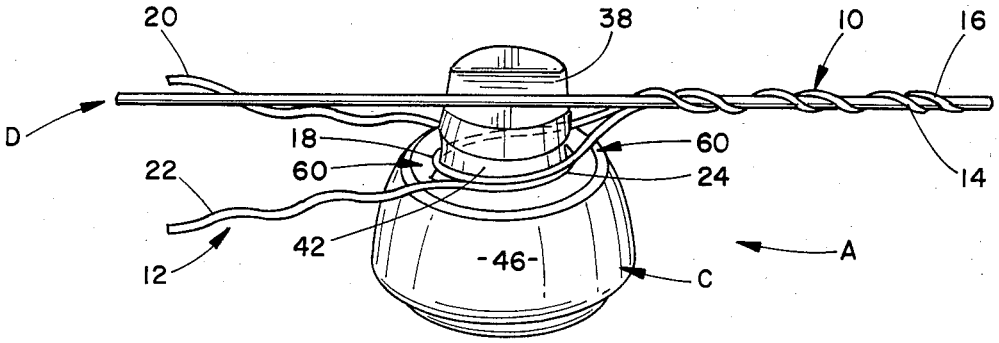
FIG. 12

LINE TIE ASSEMBLY AND METHOD

BACKGROUND OF THE INVENTION

This invention pertains to appliances used in connection with linear bodies such as cables, stranded ropes and the like, and means for securing such linear bodies to various types of support devices. The invention is particularly applicable to electrical conductor cables and insulator support members and will be described with particular reference thereto. However, it will be appreciated that the invention has broader applications and may be advantageously employed in other linear body environments and applications.

Line tie assemblies and methods provide a convenient manner for securing conductor cables and the like to support devices such as insulators. Prior art and commonly assigned, structures are exhibited in U.S. Pat. Nos. 3,042,745 to Williams; 3,286,023 to Eucker; and 3,664,010 to D'Agati. Various configurations of the line ties as exemplified by the noted patents have been used with some success.

Continued refinement and simplification have developed separate line tie assemblies for side groove and top groove arrangements. These line ties are effective in securing the conductor cable in a manner designed to minimize danger of fatigue failure resulting from vibration and to eliminate chafing of the conductor cable due to looseness of the tie. These and other prior designs have also successfully utilized helical portions on the line ties that have an inside diameter slightly smaller than the diameter of the conductor cable. The helical portions are sufficiently resilient to conform to the diameter of the conductor cable and grippingly engage the cable in a circumferential manner.

Tie-top insulator supports have a transversely extending groove in the top of the insulator as well as a circumferentially extending annular groove beneath an upper lip of the insulator. The transversely extending groove of the insulator permits an installer to "top tie" a conductor cable by placing the cable within the top groove and wrapping a helical line tie to the cable and insulator thereby securing them together.

An alternative manner of assembly positions the conductor cable in an insulator side groove and thereafter secures at least one line tie about the insulator and conductor cable. In either case, the line tie secures the conductor cable to the insulator providing support for the cable.

Prior art structures such as those discussed above have been limited in the sense that the various line tie configurations accommodate either the "top tie" or, alternatively, the "side tie" arrangement, but are not equally adaptable to both. This, of course, requires a ready supply of both types of line tie assemblies to be inventoried so that an installer is prepared for either arrangement in the field.

Although insulator manufacturers have standardized dimensions within a given insulator class, dimensions of various classes must necessarily be different because usage is different. Usage dictates mechanical and electrical requirements and sets practical dimensional limits. Present industry manufacturing methods and practices preclude the probability of ever achieving a common dimension for all available insulators. Therefore, installers must necessarily inventory different line ties to satisfy different size insulators.

It has, therefore, been considered desirable to provide a line tie that is simple to manufacture and install. The line tie should be "universal" i.e. accommodate both side or top groove arrangements in both single-support and double-support constructions as well as various size insulators. Each line tie should be constructed of a material which allows ready forming in the field and yet provides stability, positive centering, and inline application without the need of special tools. Additionally, the procedure should be consistent and repeatable thereby facilitating installation. These and other benefits are provided by, the subject invention overcoming the above-noted deficiencies.

SUMMARY OF THE INVENTION

In accordance with one aspect of the subject invention, there is provided a method of securing a cable to an insulator. The method generally includes providing a line tie comprised of two components having non-helical central portions disposed between helical portions. The cable is engaged in a top groove of the insulator. The central portions of the line tie components are aligned with one another, spread apart, and maneuvered about the insulator and cable into sliding engagement with side grooves of the insulator. The helical portions of the line tie components are wrapped in circumferential gripping engagement with the cable.

In accordance with a first alternative method of securing a cable to an insulator, the central portions of the line tie components are aligned with one another and spread apart into sliding engagement with a side groove of the insulator. The cable is then positioned in a top groove of the insulator and the helical portions wrapped in circumferential gripping engagement with the cable.

In accordance with a second alternative method of securing a cable to an insulator, end portions of the line tie components are separated and positioned on opposite sides of the cable. The components are rotated until the central portions are disposed on opposite sides of the cable. Thereafter, the central portions of the line tie components are spread apart into sliding engagement with the side groove on the insulator. The cable is engaged with the insulator and the helical portions are wrapped in circumferential gripping engagement with the cable.

In accordance with another method of securing a cable to an insulator, the first and second line tie components having a generally undeformed central portion disposed between helical portions are bent into a generally U-shaped configuration. The components are separated from one another. With the cable positioned in a top groove of the insulator the apex of each U-shaped component is positioned about the insulator in opposing directions. Thereafter, the helical portions are wrapped in circumferential gripping engagement with the cable.

In accordance with still another method of securing a cable to an insulator, a line tie having a generally undeformed central portion disposed between helical portions is bent into a generally U-shaped configuration. With the cable placed in a side groove of the insulator, the apex of the U-shaped line tie is positioned about the insulator, and the helical portions are thereafter wrapped in circumferential gripping engagement with the cable.

According to yet another method of securing a cable to an insulator, a line tie having a non-helical central portion disposed between helical portions is bent into a generally U-shaped configuration. The cable is placed in a side groove of the insulator and the apex of each line tie component is positioned in the side groove at an area opposed to the cable. The helical portions are then wrapped in circumferential gripping engagement with the cable.

According to another method of the subject invention, first and second line tie components each have a non-helical central portion disposed between helical portions. The components are bent into a generally U-shaped configuration and separated from one another. The cable is placed in respective top grooves of a pair of insulators and one line tie component operatively cooperates with an insulator for securing the cable thereto.

According to another method of the subject invention, the first and second line tie components each have a non-helical central portion disposed between helical portions. The components are bent into a generally U-shaped configuration and separated from one another. The cable is placed in respective side grooves of a pair of insulators and one lie tie component operatively cooperates with an insulator for securing the cable thereto.

It is a principal advantage of the subject application to provide a line tie assembly and method that can be used on both side and top groove arrangements.

Another advantage is found in the adaptability of the line tie assembly to single-support as well as double-support arrangements.

Still another advantage resides in the adaptability of the line tie assembly to various size insulators.

Another advantage is provided in the low cost to manufacture as well as a simplified field forming and installation of the line ties.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein:

FIG. 9 is a perspective view of forming the line tie into a U-shaped configuration by using the insulator as a mandrel in accordance with another method;

FIG. 10 shows the line tie in a deformed, generally U-shaped configuration;

FIG. 11 shows the generally U-shaped line tie components in separated, opposed arrangement;

FIG. 12 shows an alternate "top tie" arrangement for installing the line ties of FIGS. 9–11:

DETAILED DESCRIPTION OF THE PREFERRED EMBODIMENT

Figures 1, 2, 3, 4, 5:
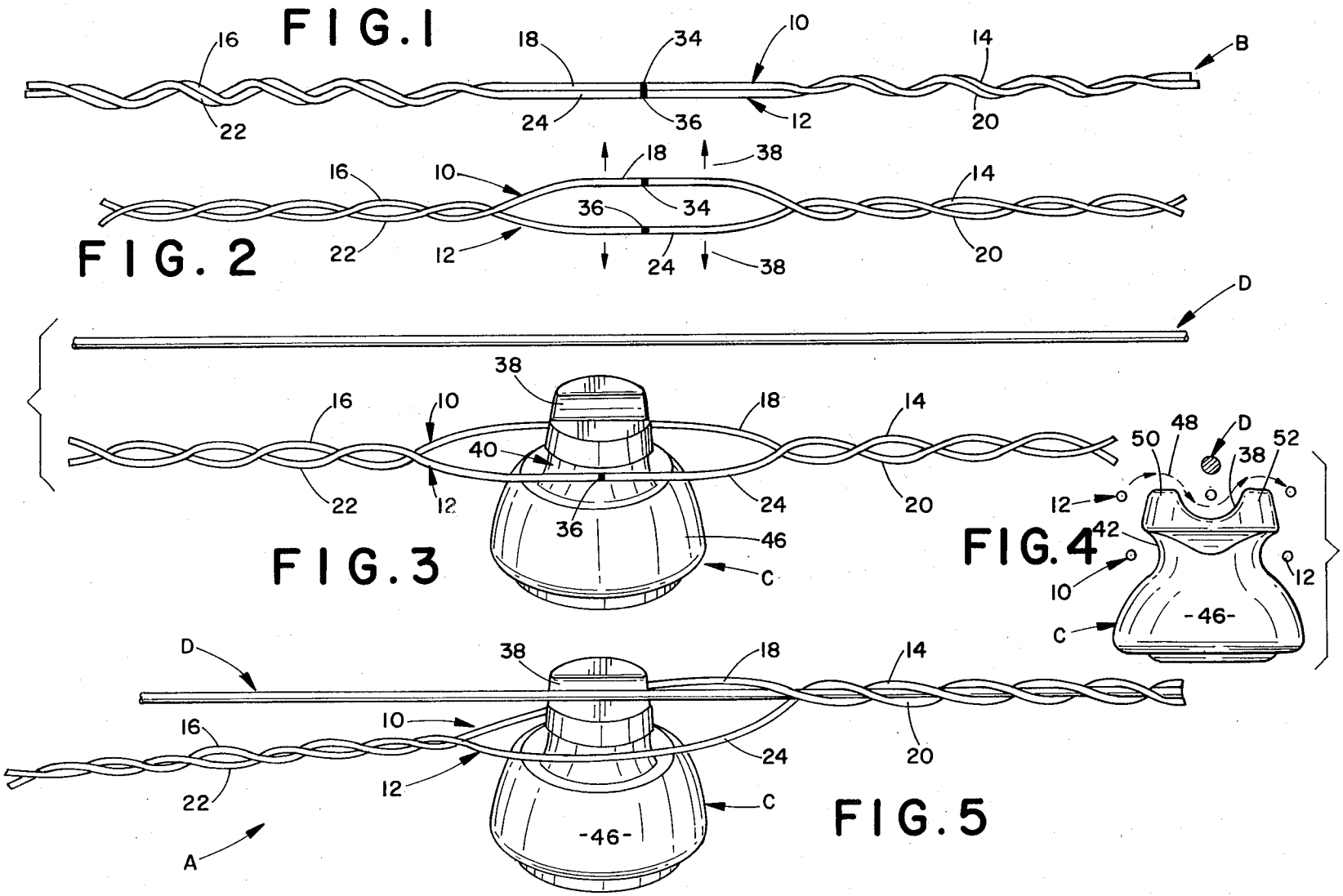
FIG. 1 is a plan view of a line tie in accordance with the subject invention.
FIG. 2 is a plan view of the line tie of FIG. 1 in which the central undeformed portions are separated.
FIG. 3 is a perspective view showing the positioning of the line tie over an insulator when the cable is spaced from the insulator.
FIG. 4 is an end view of the assembly along the longitudinal axis of the cable particularly illustrating the method of positioning the line tie components on to opposite sides of the insulator when the cable is in the insulator top groove.
FIG. 5 shows the step of wrapping line tie helical portions into circumferential gripping engagement with the cable.

Referring now to the drawings wherein the showings are for purposes of illustrating the preferred embodiment of the invention only and not for purposes of limiting same, the Figures show a line tie adapted for universal engagement in "top tie" and "side tie" arrangements.

Turning now to FIGS. 1–6, a universal line tie assembly A includes a line tie B, at least one insulator C, and a conductor cable D. More particularly, the line tie B includes first and second line tie components or elements 10, 12 formed from a pair of rods of aluminum-covered spring steel wire or similar material. The first line tie component 10 includes a helical portion 14 at one end and a second helical portion 16 at the other end. A non-helical central portion 18 is disposed between the helical portions 14, 16. Preferably, the non-helical portion is undeformed, maintaining a substantially linear configuration.

The second line tie component 12 is similarly configured. It includes helical portions 20, 22 disposed at opposed ends and an undeformed, non-helical central portion 24 therebetween. Use of helical portions for gripping is well known in the art. A variety of prior art structures use helices to grip and tightly hold a cable to support devices. Therefore, a description of the method of forming helical tie portions in addition to the precise mechanics of the cable gripping engagement is deemed unnecessary to a complete understanding of the subject invention.

The first and second line tie components 10, 12 may be packaged as a set in which the central undeformed portions 18, 24 are in closely spaced relation. The helical portions of each line tie component follow the same curvature and are generally "in phase". Indicia 34, 36 may be provided on the central portions of the line tie components 10, 12, respectively, in order to facilitate positioning of the components with respect to the insulator as will be described further hereinbelow.

With particular reference to FIG. 2, the undeformed central portions are spread apart as indicated by arrows 39 into spaced relation. The helical portions rotate relative to one another presenting a pair of standing waves generally 180° out of phase. With further reference to FIGS. 3 and 4, the central portions 18, 24 are positioned for close receipt with an insulator C. The insulator is of conventional construction and includes an uppermost, transversely extending groove 38. The groove 38 is designed to receive the conductor cable D for all "top tie" arrangements. A necked down portion 40 forms an annular or side groove 42 adapted to receive the line tie components 10, 12 and/or the conductor cable D for all "side tie" arrangements. The side groove is generally perpendicular to groove 38. A radially enlarged body portion 46 extends downwardly from the necked down portion preventing moisture accumulation.

The spaced apart central portions 18, 24 are positioned for receipt in the side groove 42 of the insulator. The indicia 34,36 facilitate centering of the line tie components with the insulator. If the conductor cable D is spaced or elevated from the insulator with lift sticks or other conventional means, the line tie can be positioned directly on the insulator before the conductor cable is lowered. FIG. 3 is representative of this type of situation where the cable is spaced from the insulator. The central portions 18, 24 are sufficiently spread apart to snap into the annular groove 42 on opposed areas thereof.

More often than not, the cable is in place in groove 38. As illustrated in FIG. 4, the components 10, 12 are placed in side groove 42. The second component 12 follows a generally M-shaped path indicated by arrow 48. In this manner, the second component central portion is drawn up and over a first lip 50 of the insulator, across the top groove 38 beneath the cable, and over a second lip 52 of the insulator. At this point, the second line tie component snaps into retaining engagement with the side groove 42 at an area opposed to the component 10. The cable defines a longitudinal axis and it is understood that the cable may be an electrical conductor cable or any similar linear body.

Figure 6:
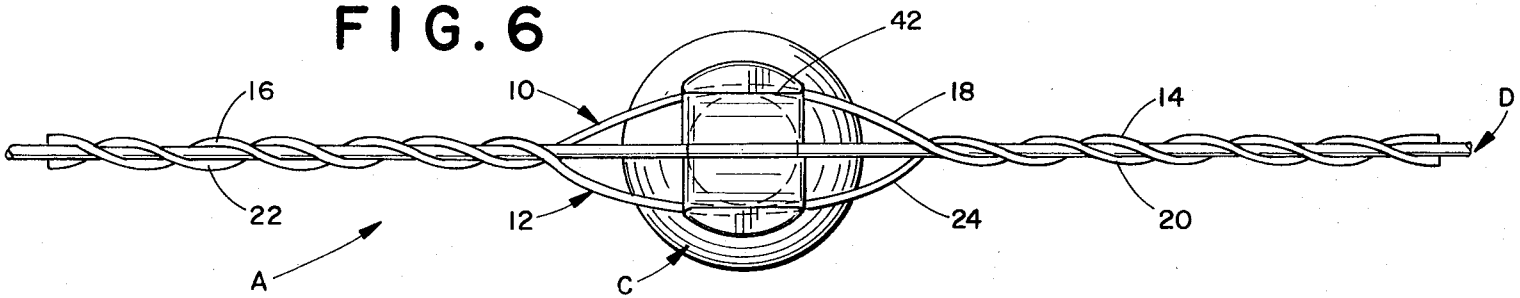
FIG. 6 is a plan view of the completed "top tie" assembly.

With particular reference to FIGS. 5 and 6, once the central portions are positioned in the side groove 42 by either of the method noted above, helical portions 14, 20 are wrapped in circumferential gripping engagement with conductor cable D. The helical portions are preferably factory-formed to have an inner diameter slightly smaller than the diameter of the conductor cable D. The resilient material construction of the line tie expands to accommodate the larger diameter of the cable. In this manner, a tight gripping relationship between the helices and the conductor cable is attained. Further, the helical portions are preferably formed to have a pitch length sufficiently long such that they may be applied sideways to a conductor cable without exceeding their elastic limits.

Once the helical portions 14, 20 of the first and second line tie components have been completely wrapped about the cable D, the helical portions 16, 22 at the other end of the line tie components are likewise wrapped in circumferential gripping engagement with the cable D. As illustrated in FIG. 6, each line tie component in the completed assembly extends generally along the longitudinal axis defined by the cable. The non-helical portions 18, 24 securely grip the side groove 42, while the cable D is retained in the top groove 38 of the insulator.

Figure 7:
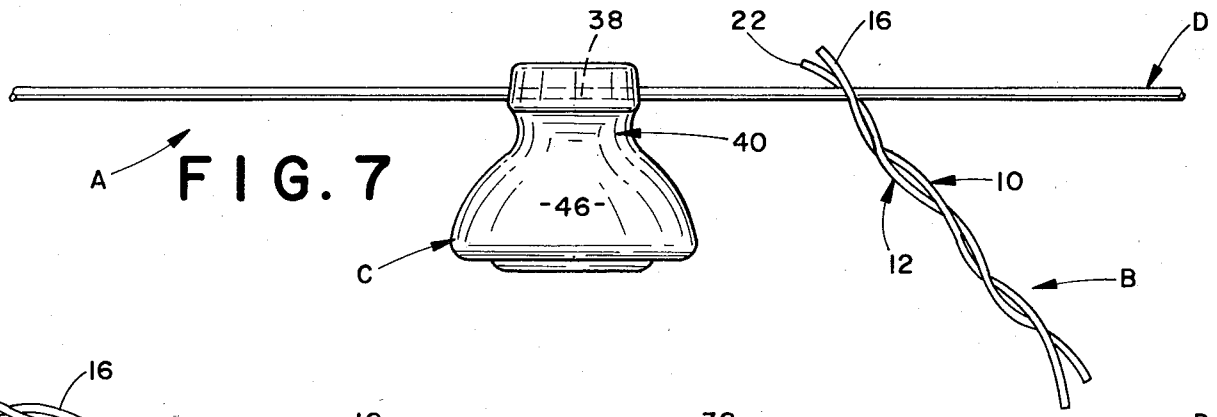
FIG. 7 is a side elevational view illustrating the initial step in an alternative method of installing the line ties with respect to the cable.
Figure 8:
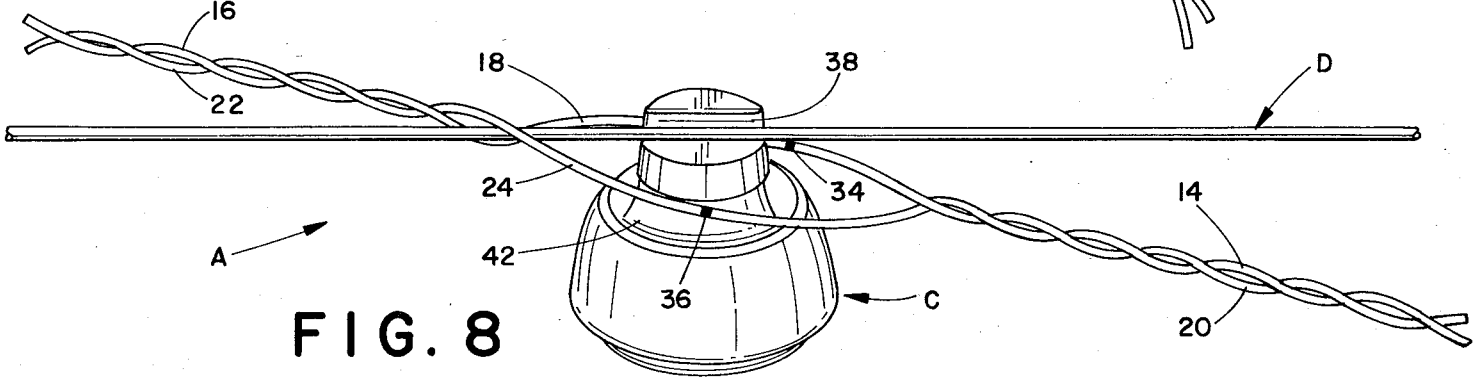
FIG. 8 is a side perspective view showing a further step in the alternative installation method of FIG. 7.

With reference to FIGS. 1, 2, and 614 8, an alternative "top tie" method of assembly will be described. For ease of illustration, like elements are identified by like numerals. Line tie components 10, 12, of line tie B, having the same configuration as described above, fasten a conductor cable D to an insulator C. As seen in FIG. 7, the outmost ends of helical portions 16, 22 are sufficiently spread apart and positioned on either side of the conductor cable D. Simultaneous axial and rotational movement of the line tie components 10, 12 with respect to the cable positions the cable generally between the undeformed, non-helical portions 18, 24 as shown in FIG. 8. The indicia 34, 36 are aligned with the conductor cable indicating correct placement of the line ties. Thereafter, the line tie components are aligned in generally parallel relationship with the cable and positioned in side groove 42. The helical portions 16, 22 are then wrapped in circumferential gripping engagement with the cable D. Thereafter, the helical portions 14, 20 are likewise wrapped about the cable. A completed "top tie" assembly as shown in FIG. 6 is formed by this alternative method.

With respect to FIGS. 1 and 9–12 an alternative top tie method and assembly will be described hereinbelow. Once again, for ease of illustration, like numerals will identify like elements. The first and second line tie components 10, 12, as described with reference to FIG. 1, are positioned about an insulator C whereby the non-helical, closely spaced central portions are placed in abutting engagement with a side groove of the insulator (FIG. 9). Using the insulator as a mandrel, the helical portions 14, 20 and 16, 22 are bent toward one another as indicated by the arrows. The material of construction of the line tie is sufficiently deformable to assume the generally U-shaped configuration as illustrated in FIG. 10. It is contemplated that any other conventional mandrel can be used with equal success, but the ability to use the insulator as a mandrel is preferred. The indicia 34, 36 are positioned on the insulator prior to bending and generally define an apex 60 of the non-helical portions once the line tie is bent to a U-shaped configuration. The helical portions define outer extending legs of the bent configuration. The line tie components 10, 12 may thereafter be separated as shown in FIG. 11. The helical leg portions of the respective components extend in opposite directions whereby they are wrapped in engaging relationship with an insulator C as shown in FIG. 12.

The assembly of FIG. 12 illustrates the arrangement of the first and second line tie components about the insulator. More specifically, the apex 60 of the first component 10 extends along the left-hand face of the insulator while the remaining non-helical central portion 18 rests in side groove 42 of the insulator. The helical leg portions 14, 16 are wrapped along opposed sides of the insulator generally parallel to the longitudinal axis defined by the conductor cable. As illustrated, the helical portions of the first component are brought together and wrapped in circumferential gripping relation with the cable. Similarly, the second component 12 has its apex received about the insulator C. The apex of the second component abuts the right-hand face of the insulator as shown in FIG. 12. The remainder of the non-helical central portion 24 rests in the opposed sides of groove 42. The helical leg portions 20, 22 extend generally parallel to the longitudinal axis defined by the conductor cable in a direction 180° opposed to the first component leg portions. In a similar manner, the second component leg portions 20, 22 are joined together and wrapped in circumferential gripping engagement with the conductor cable. The cable is, thereby, received in the top groove 38 of the insulator and is held in retaining engagement thereto by the line tie.

Figure 13:
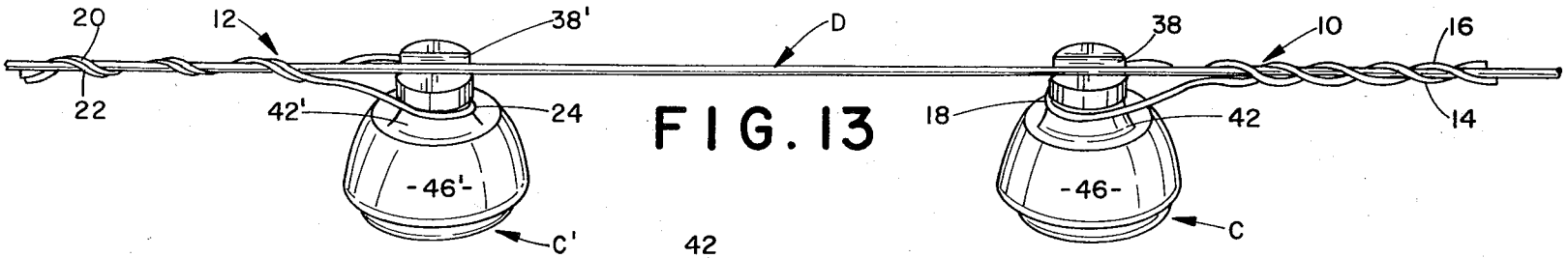
FIG. 13 illustrates a method of securing a cable to a pair of insulators using separated, opposed components.

FIG. 13 repesents a dual insulator assembly in which a first or right-hand insulator C and a second or left-hand insulator C′ are spaced a predetermined distance from one another. Once again, for ease of illustration, like elements of the line tie and first insulator will be described with like numerals, while the second insulator will be described by like numerals with a primed (') suffix. The conductor cable D extends longitudinally in supporting relationship with the insulator pair. Due to the relatively close relationship between the insulators C, C', a single line tie component cooperates with each insulator for retaining the cable in the top groove 38 thereof. A line tie B, as shown in FIG. 1, is bent into a generally U-shaped configuration as described above with respect to FIGS. 9 and 10. The line tie components are then separated as described with reference to FIG. 11.

Referring again to FIG. 13, the first component 10 has its apex received on the left-hand face of the insulator C and the helical portions 14, 16 extending generally parallel with the longitudinal axis defined by cable D. As previously described, the helical portions are brought together and wrapped in circumferential gripping engagement with the cable. In this manner, the first component extends around opposed portions of side groove 42 and grips the cable along a predetermined length, securely fastening the cable in the top groove. The helical portions grip the cable in a longitudinal direction away from the second insulator C'.

In the same manner, the second component 12 has its apex received on a right-hand surface of the insulator C', specifically, groove 42'. The helical leg portions extend in a direction 180° opposed to the leg portions of the first component and are wrapped in circumferential gripping engagement with the cable. The cable therefore has a portion extending between the insulators C, C' which is free of any line tie assembly.

Figure 14:
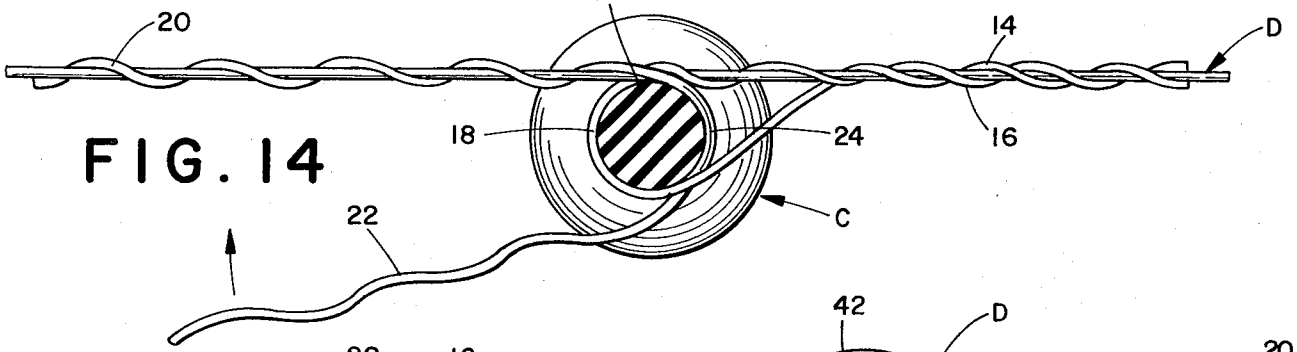
FIG. 14 shows a partially-completed, further alternative assembly and method of securing a side groove assembly.
Figure 15:
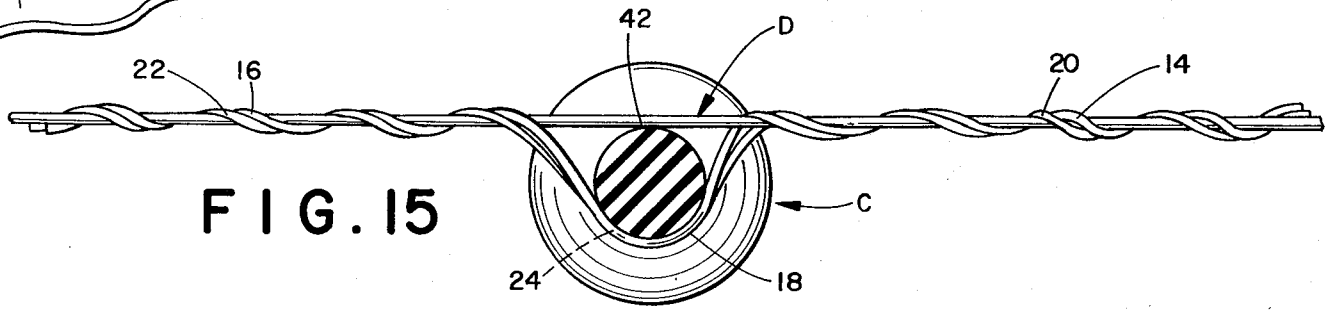
FIG. 15 shows an alternative side groove installation assembly.
Figure 16:
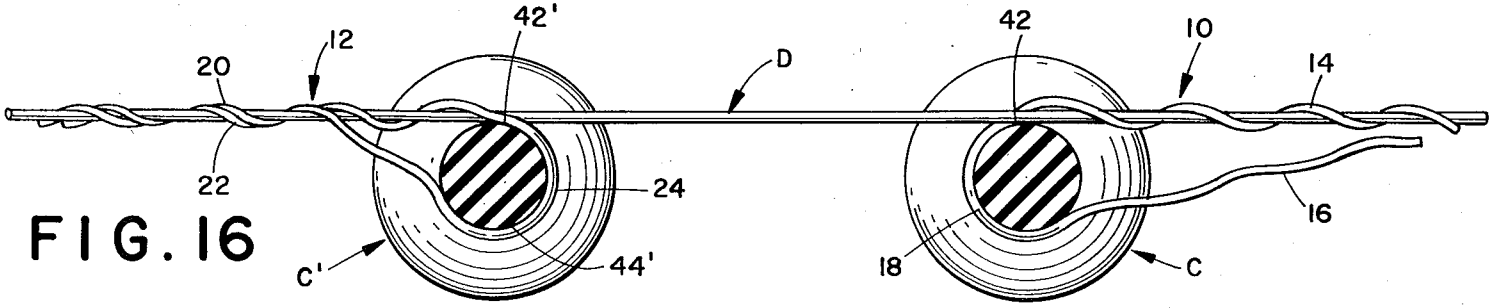
FIG. 16 shows yet another side groove assembly and method of securing a cable to a pair of insulators.

FIGS. 14, 15 and 16 illustrate three alternative "side tie" arrangements wherein like elements are described with like numerals. Once again, line tie components 10, 12 are formed into a generally U-shaped configuration as shown and described above with respect to FIGS. 9–11. With particular reference to FIG. 14, the first and second line tie components are disposed in opposing relationship on the insulator C. The apex of the first component 10 is positioned on the left-hand face of the insulator while the apex of the second component 12 abuts the right-hand face of the insulator. The conductor cable is received in a side groove 42 of the insulator. The first helical portions 14, 20 of each component are individually wrapped about the conductor cable and extend in generally opposite linear directions. This initially secures the cable to the insulator by means of both line tie components. Next, remaining helical leg portions 16, 22 of each component are wrapped in gripping relation with the circumference of the conductor cable. Once again, the helical leg portions 16, 22 extend in opposed linear directions. The completed assembly fastens the conductor cable in the side groove and the line tie components each wrap around the insulator with leg portions extending from opposed portions of the side groove.

Yet another "side tie" arrangement is shown in FIG. 15. In this embodiment, the line tie components 10, 12 may be deformed into a generally U-shaped configuration using the insulator as a mandrel as described above with reference to FIGS. 9–11. The apex of each component is positioned in side groove 42 of the insulator C. The conductor cable D is also received in the side groove 42 of the insulator but in a portion of the groove opposite the apex receiving area of the groove. The helical leg portions 14, 16 of the first component extend in generally opposite directions along the longitudinal axis defined by the cable. Similarly, the helical leg portions 20, 22 of the second component extend in opposite directions along the cable. The helical portions are wrapped in circumferential gripping engagement with the cable on either side of the insulator and the cable is free of any line tie gripping engagement along its length adjacent its receipt in side groove 42, thereby securely fastening the cable to the insulator. In other words, each line tie component extends generally linearly along the longitudinal axis defined by the cable except along an arcuate path as the components extend into side groove 42 of the insulator.

FIG. 16 employs a pair of insulators C, C', in a predetermined spaced relationship. The line tie components 10, 12 are deformed into a generally U-shaped configuration as described above and shown in FIGS. 9–11. The first component 10 has its apex in abutting engagement with the left-hand face of insulator C. The helical leg portions 14, 16 are wrapped around the insulator and extend in a generally linear direction away from insulator C'. The helical leg portions circumferentially grip the conductor cable in much the same manner as described above with respect to the single insulator assembly of FIG. 14. This fixedly retains the cable D in a side groove 42 of the insulator C. The second component 12 has its apex abutting a right-hand face of the insulator C'. The conductor cable is similarly received in a side groove 42' of the insulator and the helical leg portions of the second component wrapped around insulator C' and in a generally linear direction away from insulator C. Likewise, the helical leg portions circumferentially grip the cable D. In this manner, the conductor cable rests in predetermined side grooves of insulators C, C' and each line tie component extends from engagement with the side groove of its respective insulator.

As is apparent from the above description of the preferred line tie assemblies and methods, a line tie is adapted for securing a conductor cable to an insulator or pair of insulators in various manners. The undeformed, non-helical central portion of each line tie component provides sufficient adaptability to various sizes of insulators. A conductor cable or the like is secured to a support in either a "top tie" or a "side tie" arrangement. Moreover, the conductor cable can be adequately fastened to either a single insulator or a pair of spaced insulators.

The invention has been described with reference to the preferred embodiments and methods. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A method of securing a cable to an insulator comprising the steps of:

providing a line tie having first and second components, each component having a non-helical central portion disposed between helical portions having the same lay;

aligning said central portions adjacent one another;

spreading said central portions apart and sliding said central portions into engagement with a first groove on opposed sides of said insulator;

placing said cable in a second groove of said insulator; and, wrapping said helical portions in the same direction and in circumferential gripping engagement with said cable.

2. The method as defined in claim 1 wherein said placing step is prior to said spreading step.

3. The method as defined in claim 1 wherein said spreading step includes placing said first component in said first groove of said insulator, pulling said second component between said insulator and said cable across said second groove to an opposed area of said first groove.

4. The method as defined in claim 1 wherein said wrapping step includes applying said helical portions to said cable on one side of said insulator, then applying said remaining helical portions to said cable.

5. A method of securing a cable to an insulator comprising the steps of:

providing a line tie having first and second components, each component having a generally undeformed central portion disposed between helical portions having the same lay;

positioning said central portions on opposite sides of said cable whereby said cable is captured therebetween;

spreading said line tie central portions apart and sliding said central portions into engagement with opposed areas of a first groove on said insulator;

placing said cable in a second groove of said insulator; and, wrapping said helical portions in the same direction and in circumferential gripping engagement with said cable.

6. The method as defined in claim 5 wherein said positioning step further includes separating end portions of said first and second components prior to positioning said first component end portion on one side of said cable and said second component end portion on the other side of said cable.

7. A method of securing a cable to an insulator comprising the steps of:

providing a line tie having first and second components, each component having a generally undeformed central portion disposed between helical portions;

rotating said first and second components until said central portions are disposed on opposite sides of said cable;

positioning said central portions on opposite sides of said cable whereby said cable is captured therebetween;

spreading said line tie central portions apart and sliding said central portions into engagement with opposed areas of a first groove on said insulator;

placing said cable in a second groove of said insulator; and, wrapping said helical portions in circumferential gripping engagement with said cable.

8. The method as defined in claim 7 further including aligning said components generally parallel to said cable after said rotating step.

9. A method of securing a cable to an insulator comprising the steps of:

providing a line tie having first and second components, each component having a non-helical central portion disposed between helical portions having the same lay;

bending said central portions into a generally U-shaped configuration having an apex and outer extending leg portions;

placing said cable in a side groove of said insulator;

positioning said apex of each of said components in an opposed area of said side groove; and, wrapping said leg portions in the same direction and in circumferential gripping engagement with said cable.

10. In combination:

an insulator having a first groove;

a cable received in said insulator first groove and defining a longitudinal axis;

a line tie having helical portions having the same lay at opposed ends thereof and a non-helical portion disposed therebetween, said non-helical portion closely received in said first groove at an area opposite said cable and said helical portions extending in circumferential gripping engagement with said cable in opposite directions along said longitudinal axis from said insulator, said cable being free of gripping engagement with said line tie along said insulator first groove.

11. The combination as defined in claim 10 wherein said line tie extends continuously from said cable on one side of said insulator, to said first groove, and to said other side of said insulator defining a generally arcuate path.

12. A method of securing a line cable to an insulator comprising the steps of:

providing first and second line tie components having a generally underformed central portion disposed between helical portions having the same lay;

bending said first and second components along respective central portions into generally U-shaped configurations each having an apex and outer extending leg portions;

positioning said apexes of said first and second components in a side groove of said insulator;

placing said cable in said side groove of said insulator; and, wrapping said first and second components helical portions in circumferential gripping engagement with said cable.

13. The method as defined in claim 12 comprising the further steps of:

positioning said apex of said second component about a second insulator and further positioning said second component in a direction opposed to said first component.

* * * * *